United States Patent [19]

Makino et al.

[11] 4,444,602

[45] Apr. 24, 1984

[54] METHOD OF MANUFACTURING AMORPHOUS MAGNETIC ALLOY RIBBON AND USE FOR MAGNETOSTRICTION DELAY LINES

[75] Inventors: Yoshimi Makino; Yoshitaka Ochiai; Koichi Aso; Satoru Uedaira, all of Yokohama; Masatoshi Hayakawa, Chigasaki; Kazuhide Hotai, Yokohama, all of Japan

[73] Assignee: Sony Corporation, Tokyo, Japan

[21] Appl. No.: 350,578

[22] Filed: Feb. 22, 1982

[30] Foreign Application Priority Data

Feb. 23, 1981 [JP] Japan ..... 56-25053

[51] Int. Cl.[3] ..... H01F 1/00

[52] U.S. Cl. ..... 148/121; 148/403; 148/31.55

[58] Field of Search ..... 148/120, 121, 403, 31.55

[56] References Cited

U.S. PATENT DOCUMENTS 4,052,201 10/1977 Polk et al. ..... 148/403
4,053,331 10/1977 Graham et al. ..... 148/120
4,053,332 10/1977 Egami et al. ..... 148/120
4,053,333 10/1977 Egami et al. ..... 148/120
4,284,441 8/1981 Satoh et al. ..... 148/120
4,288,260 9/1981 Senno et al. ..... 148/121

FOREIGN PATENT DOCUMENTS 51-73923 6/1976 Japan ..... 148/121
54-41223 4/1979 Japan ..... 148/403

*Primary Examiner*—John P. Sheehan
*Attorney, Agent, or Firm*—Hill, Van Santen, Steadman & Simpson

[57] ABSTRACT

The amorphous magnetic alloy ribbon for magnetostriction delay lines are prepared by annealing the ribbon having a negative magnetostriction constant at a temperature lower than the crystallization temperature of the alloy under a tension sufficiently enough to support the ribbon substantially straight between the both ends thereof.

The ribbon thus prepared permits a decrease in a deviation in a distribution of internal stresses and the propagation speeds of magnetostriction vibration through the ribbon.

6 Claims, 9 Drawing Figures

METHOD OF MANUFACTURING AMORPHOUS MAGNETIC ALLOY RIBBON AND USE FOR MAGNETOSTRICTION DELAY LINES

BACKGROUND OF THE INVENTION

1. Field of the Invention

The present invention relates to a method of manufacturing an amorphous magnetic alloy ribbon for magnetostriction delay lines and a use thereof for magnetostriction delay lines.

2. Brief Description of the Prior Art

There is known a magnetostriction delay line made from a magnetostrictive material, said line being capable of transmitting signals at the speed of sound by utilizing vibration resulting from magnetostriction. The magnetostriction delay line requires uniform performance. The presence of locally deviating performance, particularly with respect to the speed of sound, through the magnetostriction delay line may cause a deviation in a linear performance with respect to a delay time.

A coordinate digitizer requires a number of magnetostriction delay lines which are uniform in magnetic and mechanical characteristics. Such coordinate digitizer has a structure in which one hundred 120 cm long magnetostriction delay lines are disposed in intersecting lines with another one hundred 120 cm long magnetostriction delay lines under an application of tension. The coordinate digitizer is designed such that a pulse signal applied at one end of the magnetostriction delay line is detected by a pick-up coil mounted at an appropriate point in a plane in which the magnetostriction delay lines are disposed. A coordinate of the points where the pulse signal is detected is determined by measuring a time duration lapsed by the detection of the pulse signal in the lengthwise direction and a time duration lapsed by the detection thereof in the widthwise direction. In order to determine an accurate coordinate, it is thus required that the speed of sound is transmitted uniformly over a whole length, for example longer than several hundreds meters, of a magnetostriction delay line or a distribution in the speed of vibration propagation resulting from magnetostriction is uniform as much as possible.

An amorphous alloy metal ribbon having a positive magnetostriction constant as magnetic material is used in the prior art to form magnetostriction delay lines. The amorphous alloy metal ribbon is usually prepared by means of centrifugal quenching, single roll quenching or double roll quenching techniques. The ribbon thus prepared gives a wavy appearance, and a deviation of a distribution in internal stresses is caused during manufacture. These result in a deviation of a distribution in the sound speeds through a magnetostriction delay line thus prepared.

OBJECTS AND SUMMARY OF THE INVENTION

An object of the present invention is to provide a method of manufacturing an amorphous magnetic alloy ribbon for magnetostriction delay lines, which can decrease a deviation in a distribution of the sound speeds through the magnetostriction delay line.

Another object of the present invention is to provide a method of manufacturing an amorphous magnetic alloy ribbon for magnetostriction delay lines, which results in the manufacture thereof with ease.

A further object of the present invention is to provide a method of manufacturing an amorphous magnetic alloy ribbon from the alloy having a negative magnetostriction.

A still further object of the present invention is to provide use of such ribbon for magnetostriction delay lines.

In accordance with one aspect of the present invention, a method involves annealing an amorphous magnetic alloy ribbon having a negative magnetostriction constant at a temperature lower than the crystallization temperature of said alloy under a tension state.

In accordance with another aspect of the present invention, the amorphous magnetic alloy ribbon thus prepared is used for magnetostriction delay lines.

DESCRIPTION OF THE PREFERRED EMBODIMENTS

The amorphous magnetic alloy to be used in accordance with the present invention is an alloy having a negative magnetostriction constant $_s$. Such alloy has characteristics that, when a tension is applied, magnetic moments in the material are oriented in directions orthogonal to the direction of a tension. For reference, an alloy having a positive magnetostriction constant has characteristics that the magnetic moments are oriented in the direction of a tension applied thereto. As the magnetostriction delay lines are employed with a tension applied in the lengthwise direction thereof and a magnetic field for introducing signals thereinto is applied in the lengthwise direction thereof, it is preferred, when mutual actions of the magnetic moments which are caused to occur therein are taken into consideration, that each of the magnetic moments is oriented in a direction orthogonal to the lengthwise direction of the magnetostriction delay line, that is, so as to become parallel thereto under a magnetic field applied to the magnetostriction delay line and under a tension applied in the direction at a right angle with respect to the moment.

In accordance with the present invention, an amorphous magnetic alloy to be used as a raw material may be prepared into a ribbon shape in conventional manner. The ribbon thus prepared is then subjected to annealing at a temperature below the crystallization temperature of the alloy under a tension applied so as to keep the ribbon substantially straight between the both ends thereof. This annealing enables a removal of a wavy appearance on the ribbon which otherwise is caused to occur by the conventional techniques as well as a remarkable decrease in a deviation of a distribution in internal stresses, thereby providing a uniform distribution in the propagation speed of magnetostriction vibration or in the sound speeds and permitting an increase in a yield of the magnetostriction delay lines.

In accordance with the present invention, the tension to be applied may be appropriately below about 35 $kg/mm^2$ or less. The lower limit of the temperature to be applied during annealing may be a temperature at which atoms of the amorphous magnetic alloy ribbon can be thermally diffused or transferred and may vary with kinds of amorphous magnetic alloys to be used as raw materials. In general, the lower limit of the temperature to be applied may be ½ Tx or higher, wherein Tx is the crystallization temperature expressed in an absolute temperature. A period of time for annealing may be determined in relationship with the annealing temperature.

The ribbon thus annealed is then cooled to room temperature. The cooling may be conducted under natural conditions or at a rate of about 25° C. per second for a ribbon having a thickness of about 30 to 40 microns.

Figure 1:
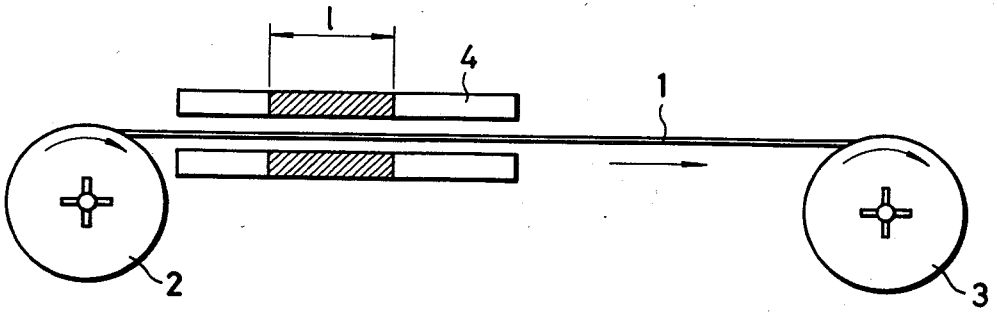
FIG. 1 is a representation illustrating an apparatus for annealing in accordance with the present invention.

Referring to FIG. 1, a construction for annealing an amorphous magnetic alloy ribbon in accordance with the present invention is seen to comprise the amorphous magnetic alloy ribbon 1 wound on a feed reel 2 and fed so as to be wound on a winding reel 3. During the course of transfer through a heater 4 is heated the ribbon for annealing under the predetermined conditions. In FIG. 1, the reference symbol 1 means a zone where the annealing temperatures are maintained constant. The required tension is applied to the ribbon by adjusting a force of supporting the ribbon from the winding reel 3. The apparatus of this type can be advantageously employed to continuously anneal the ribbon.

EXAMPLE 1

An amorphous alloy ribbon having a composition of $Co_{70}Ni_6Si_{15}B_9$, a crystallization temperature Tx of 465° C., a Curie temperature Tc of 345° C., a magnetostriction constant $_s$ of about $-5\times10^{-6}$ and a saturated flux density of about $7\times10^3$ Gauss was prepared in accordance with the procedures described in U.S. Pat. No. 4,212,344. With ribbon specimens having a length of 120 cm, a width of 1 mm and a thickness of 30 to 40 microns, the ribbons were annealed at a temperature Ta under a tension Wa at a rate Va through a heater. The length l of a zone of the heater where the annealing temperatures were maintained constant was 10 cm. The annealing conditions were varied as follows:

(a) Ta=430° C., Wa=340 g (about 10 $kg/mm^2$), Va=20, 30, 40, 50, 60 and 100 cm/min.;

(b) Ta=430° C., Va=100 cm/min., Wa=ca. 0 (least tension sufficiently enough to support the ribbon straight), 120, 220 and 320 g.; and (c) Va=100 cm/min., Wa=330 g and Ta=330°, 376° and 430° C.

Figure 2A:
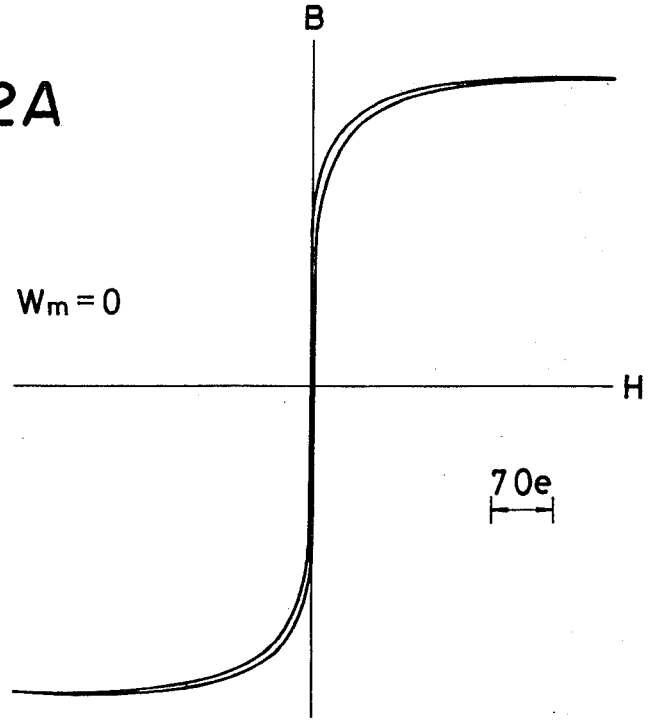
FIGS. 2A and 2B are each a hysteresis loop of an amorphous magnetic alloy ribbon prior to annealing.
Figure 2B:
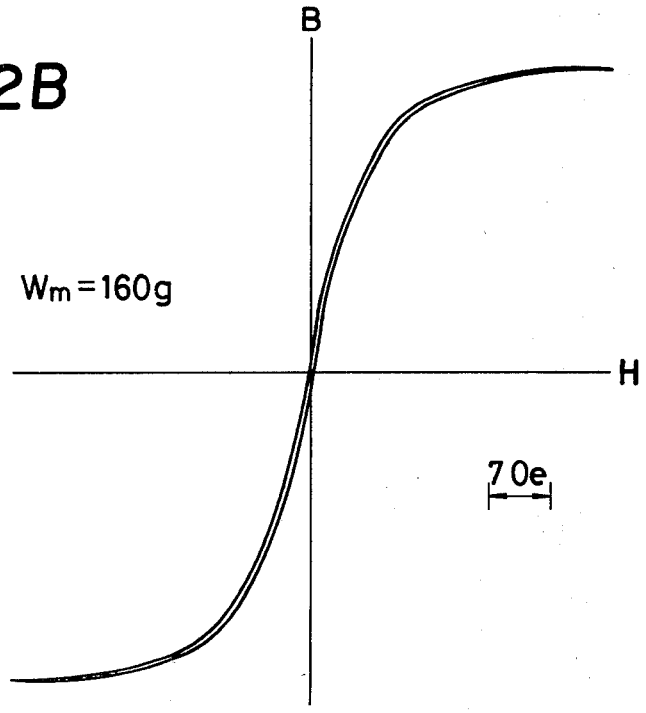
Figure 3A:
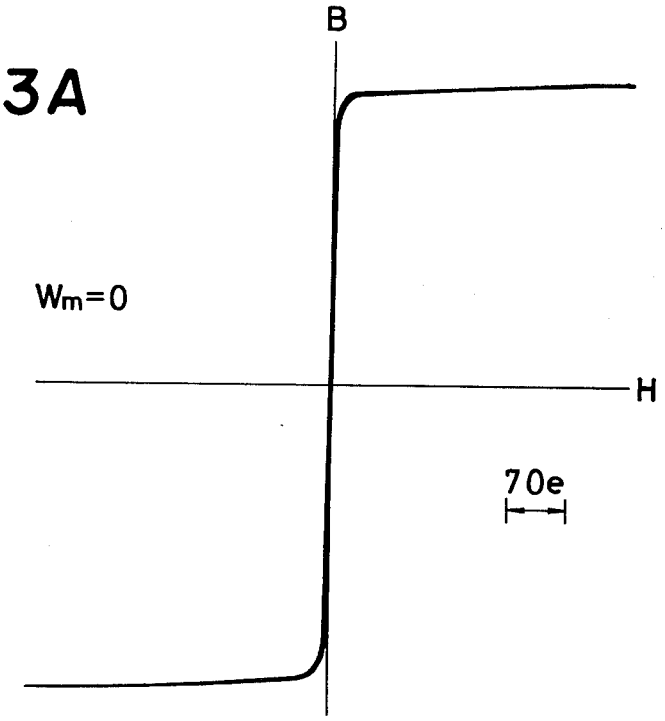
FIGS. 3A and 3B are each a hysteresis loop of the amorphous magnetic alloy ribbon subsequent to annealing.
Figure 3B:
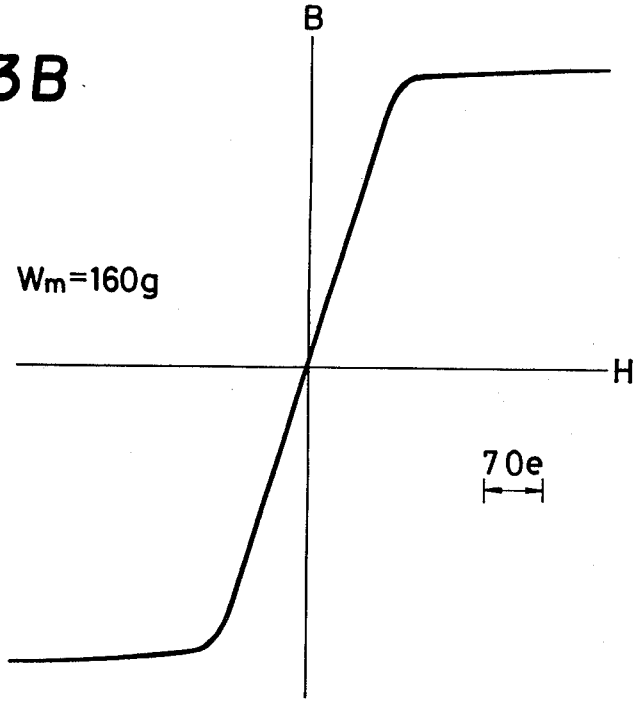

The ribbons were measured for a variation in magnetic characteristics as an AC hysteresis loop at 7 Hz. The ribbons prior to annealing were found to give a hysteresis loop at no measuring load as shown in FIG. 2A and that at a measured load of 160 grams as shown in FIG. 2B. These ribbons were annealed under the conditions as enumerated in items (a) and (b) above, respectively, and found to have the hysteresis loop under no measuring load as shown in FIG. 3A and that under a measured load of 160 grams as shown in FIG. 3B. It is now found that the hysteresis loops for the ribbons subsequent to annealing are rendered simple in form in comparison with that of the ribbons prior to annealing. It is also found that, although the hysteresis loops for the ribbons prior to annealing will vary to a relatively large extent with locations of measurement, the hysteresis loops for the ribbons subsequent to annealing do not vary so much with locations of measurement and gave the hysteresis loops in substantially the same forms as given in FIGS. 3A and 3B. These mean that the annealing permits removal of a wavy appearance as well as freedom from a deviation of a distribution in internal stresses in the ribbon.

A variation in parameters for the annealing conditions as indicated in items (a) and (b) does not result in a variation in a hysteresis loop. Where the ribbon annealed under the tension Wa being substantially zero, the B-H hysteresis loop varied sharply with a small action of a measuring load. However, the shape of the hysteresis loop was substantially the same as shown in FIGS. 3A and 3B.

It is further to be noted that the ribbons annealed under the conditions of item (c) above in which the temperature Ta was 330° C. or below the Curie temperature gave a hysteresis loop locating between the hysteresis loops given in FIGS. 2A–2B and 3A–3B. With Ta being 376° C. and 430° C., the B-H hysteresis loops were given in substantially the same forms as shown in FIGS. 3A and 3B.

EXAMPLE 2

Figure 4A:
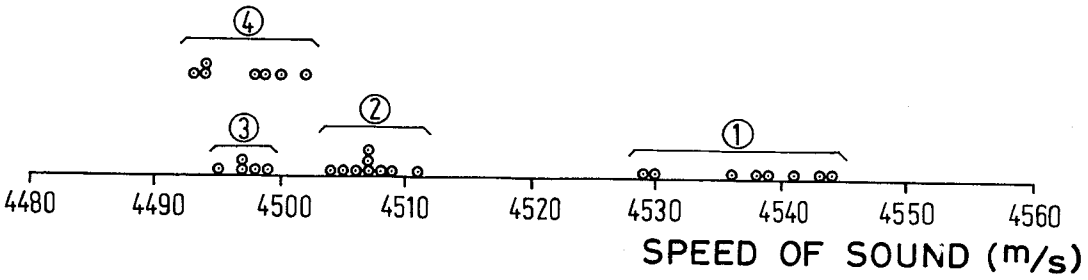
FIGS. 4(*a*) and 4(*b*) are each a graph illustrating a variation in a distribution in the sound speeds through the ribbons.
Figure 4B:
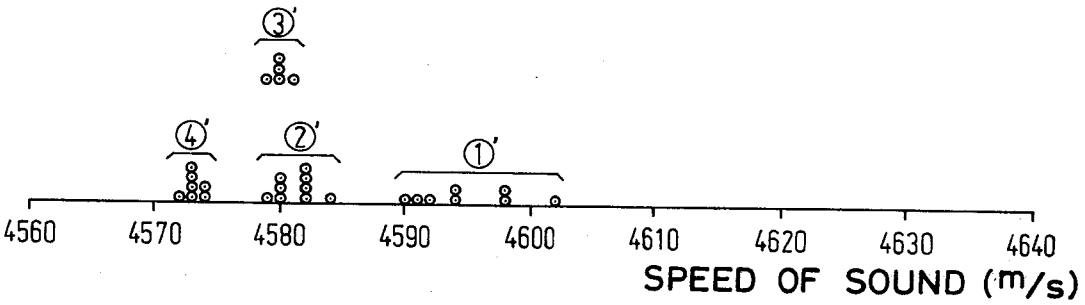
Figure 5:
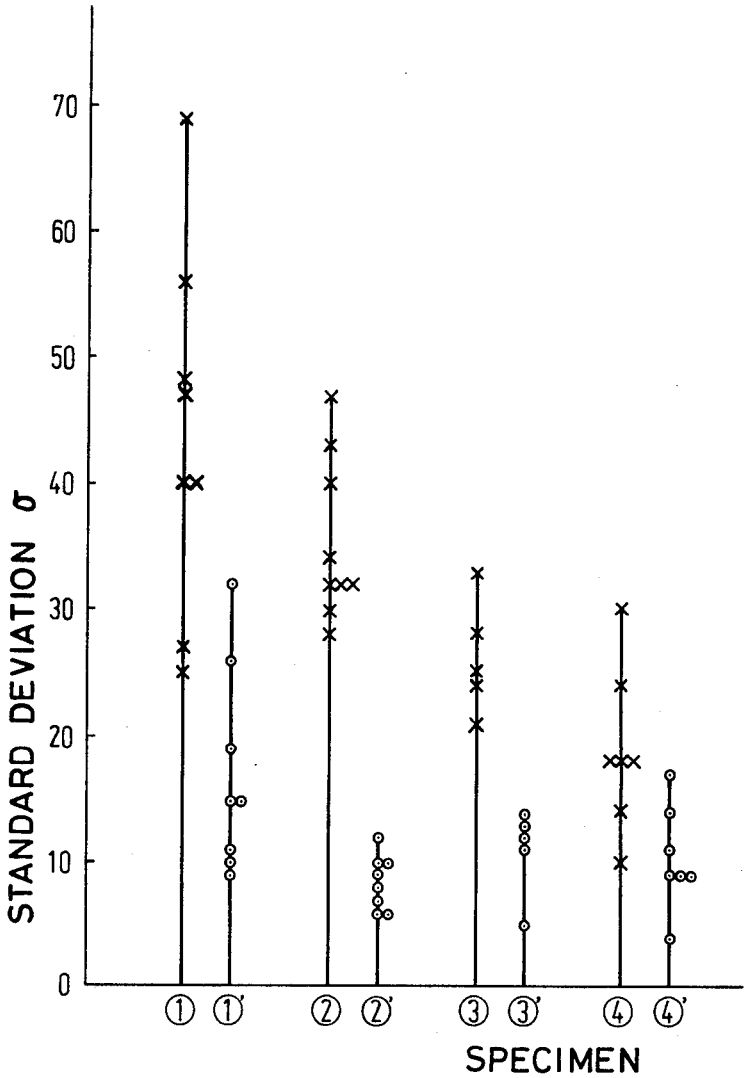
FIG. 5 is a graph illustrating a standard deviation with respect to the ribbons.
Figure 6:
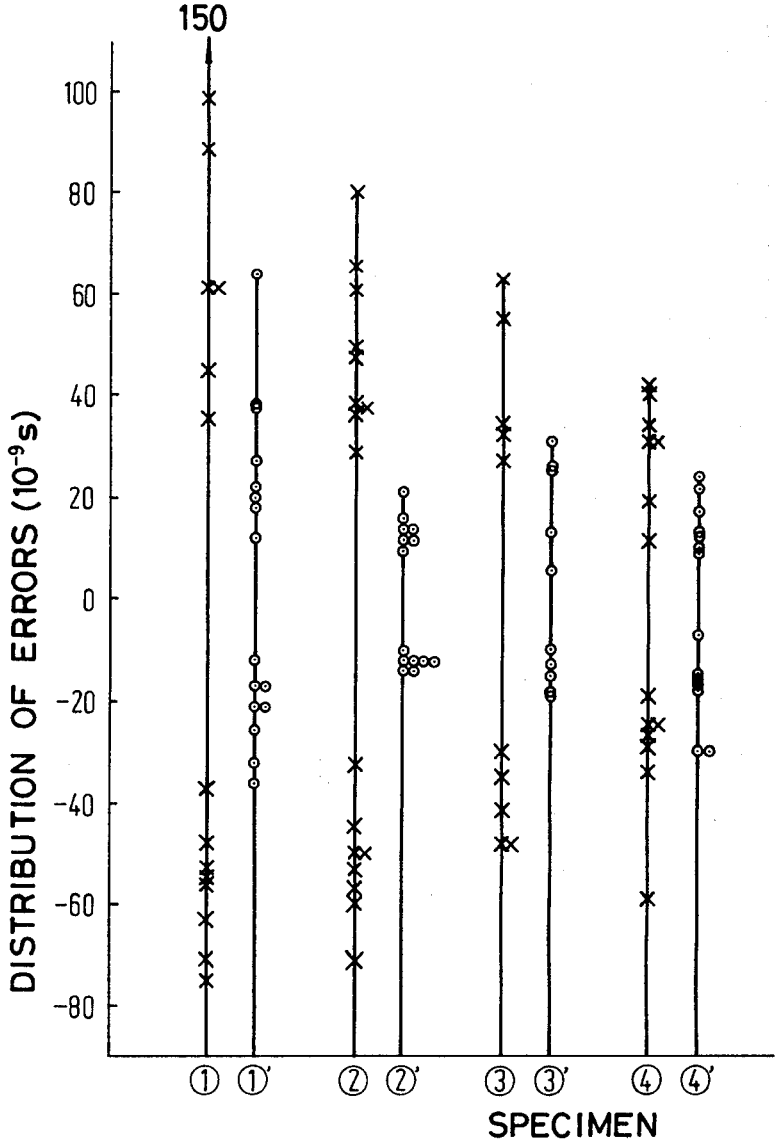
FIG. 6 is a graph illustrating a distribution in errors with respect to the ribbons.

The ribbons prepared in the same manner in Example 1 were formed in four samples having a length of 10 cm as shown in FIGS. 4 through 6 as Specimens 1 through 4. The samples were annealed at an annealing temperature Wa of 400° C. under a tension Wa of about 350 through 400 grams at a transfer rate of about 60 cm per minute. The annealed samples are referred to as Specimens 1' through 4', respectively, as shown in FIGS. 4 through 6.

Referring now to FIGS. 4(*a*) and 4(*b*), there are shown a distribution in the sound speeds through the ribbon samples prior to and subsequent to annealing. The measurement was made of the propagation of magnetostriction for the sample ribbon having a length of 120 cm at a current of 15 A at ten points by means of pick-up coils. The tension at the time of measurement was 150 grams and a bias magnetic field applied was 3.5 Oe.

It is apparent from FIG. 4 that the sound speeds increased by about 1.5% by the annealing. What is noted to be important as a result is that a width of a total distribution of the sound speeds was shortened to about 30 m/s from about 50 m/s.

Turning now to FIGS. 5 and 6, there are shown standard deviations of a distribution in the sound speeds through one ribbon and a distribution of errors, expressed in $10^{-9}$ sec unit, in the same ribbon samples as above, respectively.

From the results obtained from FIGS. 2 through 6, it is found that the method in accordance with the present invention provides an amorphous magnetic alloy ribbon in which a deviation in a distribution of internal stresses are removed to a sufficient extent and consequently a distribution of the sound speeds through the ribbon is reduced within a shorter range.

What is claimed is:

1. A method of manufacturing an amorphous magnetic alloy ribbon for a magnetostriction delay line comprising the steps of:

providing an amorphous magnetic alloy ribbon having a negative magnetostriction constant;

annealing said ribbon at a temperature lower than the crystallization temperature of said alloy under a tension enough to keep said ribbon substantially straight between the both ends thereof;

cooling said ribbon to room temperature to produce an amorphous magnetic alloy ribbon having a uniform propagation speed of magnetostrictive vibration through said ribbon; and inserting the resulting ribbon into a magnetostriction delay line.

2. The method according to claim 1 wherein the tension is approximately 35 kg/mm$^2$ or below.

3. The method according to claim 1 wherein the annealing temperature is a temperature sufficient to at least thermally diffuse the atoms of said alloy.

4. The method according to claim 3 wherein the annealing temperature is at least about ½ of the crystallization temperature of said alloy expressed in absolute temperature.

5. The method according to claim 1 wherein the cooling is effected under ambient atmosphere or at a rate of about 25° C. per minute.

6. The method according to any one of claims 1 through 5 wherein the alloy has a compression of $Co_{70}Ni_6Si_{15}B_9$.

* * * * *